US005554233A

United States Patent [19]

Heitmann et al.

[11] Patent Number: 5,554,233

[45] Date of Patent: Sep. 10, 1996

[54] COLD DEFORMABLE, HIGH STRENGTH, HOT ROLLED BAR AND METHOD FOR PRODUCING SAME

[75] Inventors: William E. Heitmann, Crown Point, Ind.; Birchel S. Brown, Apollo Beach, Fla.

[73] Assignee: Inland Steel Company, Chicago, Ill.

[21] Appl. No.: 469,448

[22] Filed: Jun. 6, 1995

Related U.S. Application Data

[63] Continuation of Ser. No. 249,456, May 26, 1994, abandoned.

[51] Int. Cl.[6] ..... C21D 8/02; C22C 38/14; C22C 38/12

[52] U.S. Cl. ..... 148/330; 148/334; 148/602; 148/654

[58] Field of Search ..... 148/602, 603, 148/654, 330, 334

[56] References Cited

U.S. PATENT DOCUMENTS

| | | | |
|---|---|---|---|
| 3,926,687 | 12/1975 | Gondo et al. | 148/12 B |
| 4,219,371 | 8/1980 | Nakasugi et al. | 148/12 F |
| 4,289,548 | 9/1981 | Bucher et al. | 148/12 B |
| 4,474,627 | 10/1984 | Maitrepierre et al. | 148/12 B |

FOREIGN PATENT DOCUMENTS

| | | | |
|---|---|---|---|
| 0093218 | 11/1983 | European Pat. Off. | 148/330 |
| 57-34333 | 7/1982 | Japan | 148/330 |
| 58-185719 | 10/1983 | Japan | 148/602 |

OTHER PUBLICATIONS

Edmonds, D. V., The Relationship Between Structure and Properties in Bainitic Steels, *Iron & Steelmaker*, pp. 75–84 (Nov., 1990).

Serin, et al., Transformation characteristics and properties of low–carbon Nb–B steels, pp. 1–17, reproduced from *Memoires Scientifiques de la Revue de Metallurgie*, 75, 355–369 (Jun. 1978).

*Primary Examiner*—Deborah Yee

*Attorney, Agent, or Firm*—Marshall, O'Toole, Gerstein, Murray & Borun

[57] ABSTRACT

A billet of steel has a composition comprising small amounts of hardenability agents. The billet is hot rolled into a continuous bar, in two hot rolling stages with an intervening cooling step employing a turbulent cooling liquid. After the second hot rolling stage, the bar is gathered into a succession of closely overlaying loops and moved along a roller conveyor where the overlapping loops are cooled by air blowers, after which the bar is coiled. The resulting hot rolled bar has a microstincture consisting essentially of bainite in fine-sized packets reflecting an average austenitic grain size, before the gathering and cooling steps, of 8–11 ASTM. A threaded fastener in its final form can be produced from the hot rolled bar by a cold deforming operation without a heat treating operation before or after cold deforming. The threaded fastener is undistorted and contains residual compressive stresses.

50 Claims, 2 Drawing Sheets

COLD DEFORMABLE, HIGH STRENGTH, HOT ROLLED BAR AND METHOD FOR PRODUCING SAME

This is a continuation of U.S. application Ser. No. 08/249,456, filed May 26, 1994, now abandoned.

BACKGROUND OF THE INVENTION

The present invention relates generally to cold deformable, hot rolled steel bars and more particularly to high strength, hot rolled steel bars which can be cold deformed to a finished product having desirable physical properties without the need to employ heat treating either before or after the cold deforming operation.

Hot rolled steel bars are conventionally subjected to cold deforming operations such as cold drawing, cold extruding, cold heading and the like. An example of a finished product which has been subjected to cold deforming is a threaded fastener, such as a bolt or a screw. There are high-speed, fastener-making machines which form the fastener head, by cold heading, and roll the fastener threads, by cold rolling, in a single, continuous operation.

Hot rolled steel bars, from which threaded fasteners are made, must have sufficient ductility to enable one to readily perform the cold deforming operations. A conventional procedure for providing the desired ductility is to subject the hot rolled steel bar to a spheroidizing anneal, before cold deforming. The spheroidizing anneal causes practically all the carbides in the steel to agglomerate into globules or spheroids larger than one micron in diameter.

The finished, threaded fastener resulting from the cold deforming operations, should have good strength characteristics. A conventional procedure for providing the desired strength is to subject the finished, cold deformed product to a heat treatment which involved heating, quenching and tempering. Although this procedure increases the strength of the finished cold deformed product, it has other drawbacks. Heating, quenching and tempering can distort the product subjected to that treatment, so that a straightening operation would be required thereafter. Moreover, heat treating the threaded fastener after cold deforming removes residual compressive stress imparted to the threaded fastener by cold rolling the threads into the fastener, and that removal is undesirable.

SUMMARY OF THE INVENTION

The present invention provides a hot rolled steel bar which can be cold deformed into a finished product, such as a threaded fastener, without the need to subject the hot rolled steel bar to any heat treating operation. The finished, cold deformed product has good strength properties without the need to subject the finished product to any heat treating operation. Because no heat treating operation is performed on the finished, cold deformed product, the product is not distorted, thereby eliminating the need for any straightening operation; and residual compressive stresses, imparted to a threaded fastener by cold rolling the threads, are retained in the final product.

The hot rolled steel bar has a desirable combination of strength and ductility resulting from a microstructure consisting essentially of bainite having a relatively fine packet size determined at least in part by the fact that, at the conclusion of hot rolling, the steel tindergoing cooling had an austenitic microstructure with an average austenitic grain size in the range 8–11 ASTM.

The bainite microstructure described above results from a combination of (a) the composition and (b) the processing employed in the course of producing hot robed steel bars in accordance with the present invention. The microstructure of the hot rolled steel bar is devoid of large spheroidized iron carbide particles (i.e. particles larger than one micron in diameter); this is because no spheroidizing anneal or other heat treating operation is performed before (or after) cold deforming.

DETAILED DESCRIPTION

In accordance with the present invention, a steel bar is hot rolled from a billet having the steel composition ranges tabulated below. Column A lists permissible composition ranges, and column B lists preferred composition ranges. All ranges are in wt. %.

| Element | A | B |
|---|---|---|
| Carbon | 0.10–0.14 | 0.11–0.13 |
| Manganese | 1.35–1.60 | 1.40–1.55 |
| Silicon | 0.20–0.35 | 0.24–0.28 |
| Niobium | 0.05–0.10 | 0.08–0.10 |
| Boron | 0.001–0.004 | 0.001–0.003 |
| Molybdenum | 0.01–0.1 | 0.06–0.08 |
| Titanium | 0.008–0.020 | 0.010–0.015 |
| Nitrogen | less than 0.008 | less than 0.004 |
| Aluminum | 0.020–0.030 | 0.020–0.025 |

For all of the compositions listed above, the balance consists essentially of iron. There are some additional compositional considerations, and these will be discussed more fully below.

Figure 1:
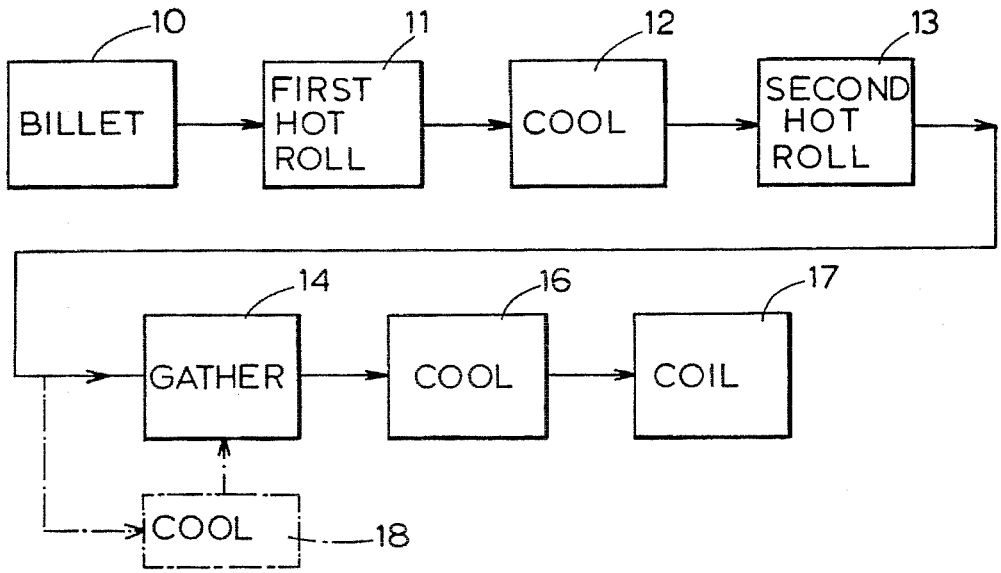
FIG. 1 is a block diagram illustrating an embodiment of a method for producing a hot rolled steel bar in accordance with the present invention.

An embodiment of a method for producing hot rolled steel bars in accordance with the present invention is discussed immediately below, with reference to FIG. 1.

A billet 10, having the composition described above, is subjected to a first hot rolling step at 11 to produce an intermediate hot rolled product. At the beginning of first hot rolling step 11, billet 10 is provided with a temperature in the range 1,175°–1,230° C. (2,147°–2,246° F.). Preferably, the billet temperature at the start of first hot rolling step 11, is in the range 1,180°–1,200° C. (2,156°–2,192° F.).

Following first hot rolling step 11, the intermediate product is cooled at 12 to a temperature in the range 780°–900° C. (1,420°–1,650° F.). Preferably, the intermediate product is cooled at 12 to a temperature below about 870° C. (1,598° F.). Typically, the intermediate product is cooled at 12 to a temperature in the range 800°–830° C. (1,472°–1,526° F.). After cooling at 12, the intermediate product is subjected to a second hot rolling step at 13 to produce a continuous hot rolled steel bar. Second hot rolling step 13 provides the continuous, hot rolled bar with an austenitic microstructure having a relatively fine average austenitic grain size in the range 8–11 ASTM (e.g., about 10).

Figure 4:
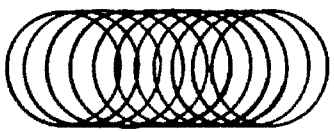
FIG. 4 is a representational plan view illustrating the disposition of partially overlapping loops of steel bars during a processing step in accordance with the present invention.

Next, the continuous hot rolled bar is gathered, at 14, into a succession of overlapping loops indicated generally at 15 in FIG. 4. As a result of the processing steps performed upstream of gathering step 14, the continuous, hot rolled steel bar is provided with a gathering temperature in the range 780°–855° C. (1,420°–1,570° F.) at the beginning of gathering step 14.

After the gathering step, the succession of overlapping loops 15 is conveyed through a second cooling stage 16 in which air at ambient temperature is blown through overlapping loops 15 to cool the loops to a temperature below 427° C. (800° F.). The loops are then coiled at 17.

During the cooling step at 16, described in the preceding paragraph, the austenitic microstructure of the hot rolled steel bar undergoes transformation into a microstructure consisting essentially of bainite having a relatively fine packet size determined at least in part by the prior average austenitic grain size of 8–11 ASTM. Preferably, overlapping loops 15 are cooled during the conveying step at 16 at a rate sufficiently rapid to substantially avoid the formation of ferrite or pearlite.

Usually, the continuous, hot rolled bar will not undergo sufficient cooling prior to the beginning of gathering step 14 to provide the desired gathering temperature of 780°–855° C. (1,420°–1,570° F.) without a deliberate cooling step at 18, between second hot rolling step 13 and gathering step 14. It is generally necessary to employ a deliberate cooling step at 18 (e.g. with turbulent cooling liquid), in order to provide the aforementioned desired gathering temperature at the beginning of gathering step 14. It is, however, sometimes possible for the hot rolled steel bar to attain the desired gathering temperature without employing such a deliberate cooling step.

Referring once again to the composition of the steel bar, the following discussion is directed to the function of the various elements in that composition.

The carbon content imparts strength to the bainite. Some of the carbon is in solid solution in the bainite; some of the carbon is present as a free dispersion of carbides, principally iron carbides, of which more will be discussed below in connection with a further discussion of the microstructure of the hot rolled steel bar.

The manganese content performs a hardenability function and helps transform the austenite into bainite as the hot rolled steel bar undergoes cooling at 16.

The silicon content functions as a deoxidizer and also imparts some solid solution strengthening to the microstructure.

The niobium and boron contents perform hardenability functions and help transform the austenite to bainite during cooling at 16. When used together, the niobium and boron contents act synergistically.

Nitrogen is present as an impurity. The titanium content functions to protect the boron from reacting with nitrogen. Absent this protective function on the part of titanium, at least some of the boron content would be tied up by the nitrogen and could not perform either the hardenability function described above or act synergistically with the niobium content. The aluminum content functions as a deoxidant and protects the titanium from reacting with whatever oxygen may be present in the steel; otherwise, the titanium could not protect the boron from reacting with nitrogen.

Titanium also acts to refine the austenitic grain size which in turn helps determine the bainite packet size which in turn determines the toughness of the steel. The finer the bainite packet size, the tougher the steel.

The molybdenum content performs a hardenability function and helps transform the austenite to bainite during cooling at 16. The molybdenum not only acts as a hardenability agent on its own, but also it acts, to some extent, synergistically with the boron and niobium to enhance the hardenability function of those two elements. Molybdenum increases the solubility of niobium in austenite and, by this mechanism, enhances the hardenability function of the niobium. Molybdenum also has a synergistic affect on the ability of boron to function as a hardenability agent, but the mechanism for doing so is unknown.

A steel composition in accordance with the present invention is devoid of vanadium, but the composition may include 0.16–0.18 wt. % chromium which functions as a hardenability agent. Nickel and copper, if present, are essentially impurities and are confined to 0.10 wt. % max. nickel and 0.12 wt. % max. copper. Although nickel is not deliberately added, to the extent that it is present as an impurity, it may perform a hardenability function.

Sulfur is usually present as an impurity and, as such, is limited to 0.010 wt. % max. If it is desired to impart additional machinability to the bar, sulfur may be employed for this purpose in an mount up to about 0.020 wt. %. The composition contains no alkaline earth metals and no rare earth metals.

Figure 5:
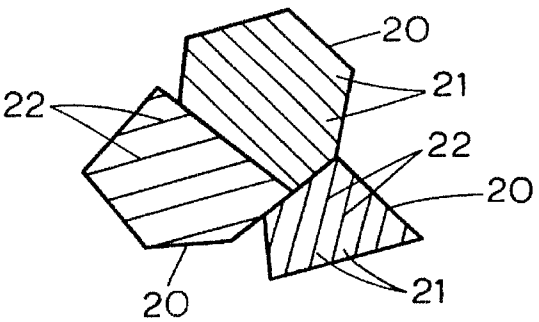
FIG. 5 is a sketch illustrating the microstructure of a hot rolled steel bar in accordance with the present invention.

Referring again to the microstructure of the hot rolled steel bar after the cooling at 16, the bainite in this microstructure is primarily upper bainite, although some lower bainite can be tolerated. More particularly, FIG. 5 representationally illustrates packets 20 of bainite each comprising a plurality of laths or elongated plates 21 each constituting highly dislocated ferrite separated by dislocations or boundaries indicated at 22. At the boundaries of these highly dislocated ferrite laths there are very fine carbide particles not readily resolvable optically and not shown in FIG. 5. The bainite packet size is related to the prior austenite grain size, although that is not the only factor involved in determining packet size. Nevertheless, control of the prior austenite grain size is at least a first step in reducing the bainite packet size so as to improve toughness.

Figure 6:
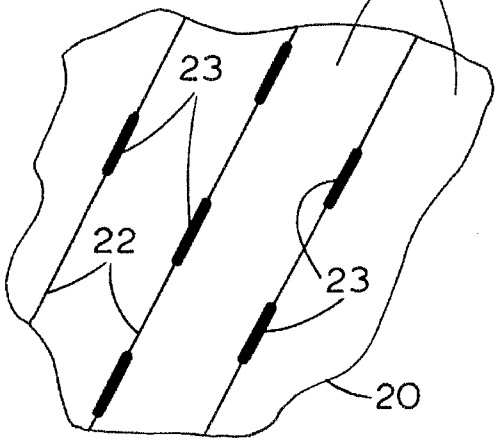
FIG. 6 is an enlarged sketch of a portion of the microstructure illustrated in FIG. 5.

In upper bainite, the carbide particles are located principally at the lath boundaries 22. In lower bainite, the carbide particles are not located at the lath boundaries but are instead located only within laths 21 in the form of very small spheroids, e.g. less than 0.1 micron. FIG. 6 depicts upper bainite comprising laths 21 having iron carbide ($Fe_3C$) particles 23 at lath boundaries (dislocations) 22. A lath 21 is typically about 1 micron wide, for example, and the very fine carbide particles in the bainite are typically about 0.1 micron wide. As shown in FIG. 6, carbide particles 23, located at lath boundaries 22, typically are elongated in the direction of a lath boundary and have a length of about 0.3–0.4 micron. A more detailed description of bahrite, its properties and characteristics, is contained in the following article which is incorporated herein by reference: Edmonds, D. V., "The Relationship Between Structure And Properties In Bainite Steels", *Iron & Steelmaker*, November 1990, p. 75. Iron and Steel Society, Inc., Warrendale, Pa.

A method in accordance with the present invention eliminates the need to perform a spheroidizing anneal on the hot rolled steel bar. Accordingly, the iron carbides in the microstructure are not spheroidized. In addition to eliminating the spheroidizing anneal, no other heat treatment is performed on the hot rolled steel bar prior to any cold deforming operation.

Referring again to the method for producing the hot rolled steel bar, the billet employed as a starting material for the method has a cross section which is typically about 6.5–7.0 in. square (16.5–17.8 cm). At first hot rolling step 11 (FIG. 1), the billet undergoes a reduction greater than 80%, typically 85%–90%, to produce an intermediate product having a cross section typically about 0.84–1.02 in. (2.14–2.60 cm) in diameter, for example; this is a feed size for a so-called "no twist" hot rolling mill which is the equipment preferably employed for performing the second hot rolling step at 13.

A "no twist" hot rolling mill is a conventional piece of equipment in which successive rolling stands are constructed so that no twisting occurs between them. A "no twist" hot rolling mill provides bars with better surface quality than a mill which does not avoid twisting between hot rolling stands. Although a "no twist" mill is preferred for the performance of second hot rolling step 13, one may alternatively employ a hot rolling mill without the advantages of a "no twist" mill. Whether one does or does not employ a "no twist" mill at 13, the hot rolling performed there provides the final cross sectional area for the hot rolled steel bar.

The cooling step performed at 12, between the first and second hot rolling steps 11, 13 respectively, and preferably the cooling step performed at 18, employ a turbulent cooling liquid, such as turbulent water, and preferably utilize a conventional piece of equipment known as a cooling tube. In this particular piece of equipment, the hot rolled bar undergoing processing moves axially in a downstream direction through the inner of a pair of concentric, horizontally disposed inner and outer tubes. A set of peripheral nozzles sprays water radially inwardly toward the bar as it moves axially through the inner tube which fills up with the cooling water which is drained from the inner tube into the outer tube at a location spaced axially from the location of the peripheral nozzles. Spent cooling water which drains from the inner tube into the outer tube is then carded away from the outer tube.

Figure 3:
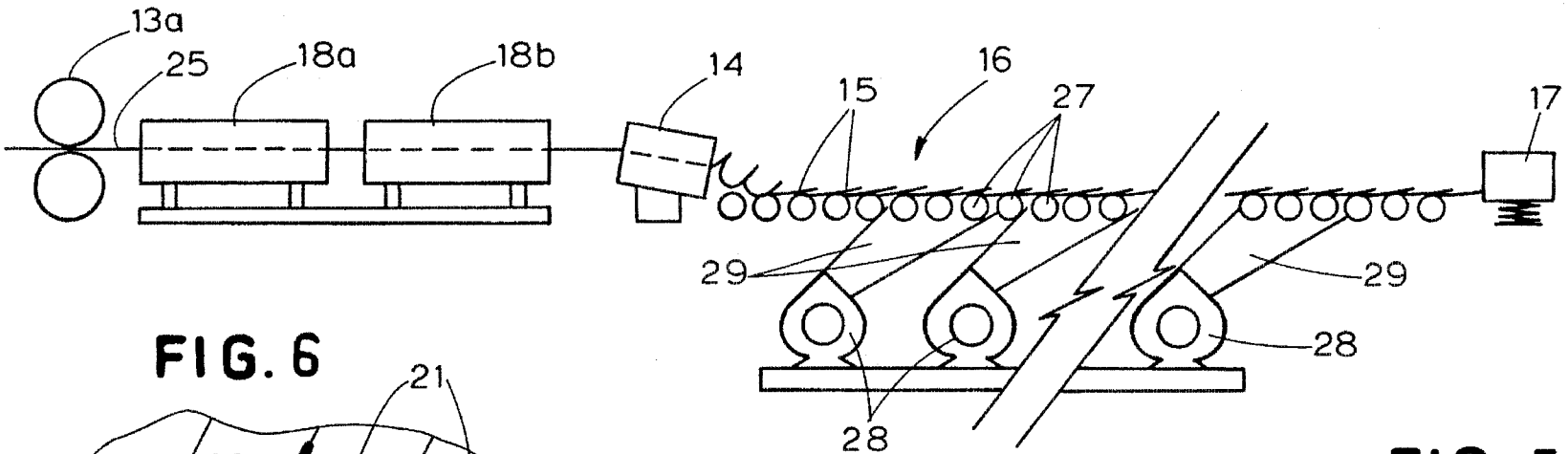
FIG. 3 is a schematic flow diagram illustrating part of an embodiment of a method in accordance with the present invention.

The flow of turbulent cooling water through the cooling tube, relative to the movement of the bar, may be co-current flow or counter-current flow or each of these flows in sequence. The latter type of cooling arrangement is illustrated in FIG. 3 which shows a steel bar 25 exiting the last roll stand 13*a* of a "no twist" mill for performing second hot rolling step 13. Hot rolled bar 25 then passes, in sequence, through a cooling tube 18*a* in which there is co-current flow of turbulent cooling water and then through a second cooling tube 18*b* in which there is counter-current flow of turbulent cooling water. After cooling tube 18*b*, the bar moves to a gathering stand at 14.

A sequence of cooling tubes like 18*a* and 18*b*, or one of them alone, may also be employed in first cooling step 12 for cooling the intermediate product between the rust and second hot rolling steps 11, 13 respectively.

As previously indicated, the cooling step performed at tubes 18*a*, 18*b* need not be employed if the temperature of bar 25 as it exits last roll stand 13*a* is at the desired gathering temperature in the range 780°–855° C. (1,420°–1,570° F.). Steel bar 25 has either air-cooled, or has been liquid-cooled, to a temperature in this range by the time the bar arrives at gathering stand 14.

As noted above, at gathering stand 14, hot rolled bar 25 is gathered into a succession of overlapping loops indicated generally at 15 in FIG. 4. As shown in FIG. 3, this succession of overlapping loops 15 is conveyed along a roller conveyor to a coiling station 17. The roller conveyor comprises a multiplicity of horizontally spaced rollers 27. Located below rollers 27 are a series of air blowers 28 for blowing air through ducts 29 which direct the cooling air angularly upwardly through the spaces between horizontally spaced rollers 27 and against the succession of overlapping loops 15 moving in a downstream direction along the conveyor defined by horizontally spaced rollers 27. The cooling arrangement described in the preceding part of this paragraph, and shown schematically in FIG. 3, is known as a Stelmor™ conveyor and is available commercially.

The arrangement described in the preceding paragraph acts to cool loops 15 to a temperature below 427° C. (800° F.) and corresponds to cooling step 16 in FIG. 1. The transformation from austenite to bainite is occurring as steel bar 25 is cooled while moving along rollers 27.

The cooling air from blowers 28 is initially at ambient temperature. In the course of cooling overlapping loops 15, the air undergoes heating, and, in the illustrated embodiment, the heated air is dissipated directly into the ambient atmosphere surrounding cooling station 16.

At coiling stand 17, the succession of overlapping loops 15 is arranged into coils of hot rolled steel bars, employing conventional coiling and banding procedures and equipment. In an alternative, less frequently employed procedure, steel bar 25 may be un-looped, straightened and sheared into lengths. Whenever reference is made herein to coiling the loops, that reference should be understood to encompass the alternative procedure described in the preceding sentence.

Figure 2:
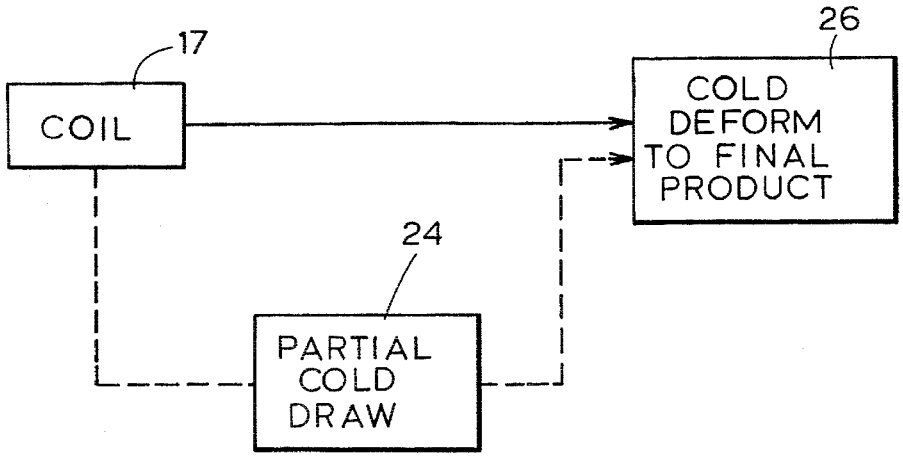
FIG. 2 is a block diagram illustrating an embodiment of a method for producing a final, cold deformed product from a hot rolled steel bar produced in accordance with the present invention.

The hot rolled steel bars may be shipped to a customer without any further processing, or before shipping to the customer, the hot rolled steel bars may be subjected to a partial cold drawing operation represented at 24 in FIG. 2. In the latter case, before one can partially cold draw, one must first subject the bars to cleaning, coating and lubricating procedures, all of which are common, conventional expedients employing conventional procedures and equipment. There is no spheroidizing anneal between coiling step 17 and partial cold drawing step 24, nor is there any other heat treating operation performed before or after partial cold drawing step 24.

In that embodiment in which no partial cold drawing is performed, there is no spheroidizing anneal after coiling step 17, nor is there any other heat treating operation after coiling step 17.

After cooling step 16, the steel bar has a bainite microstructure of the type described above. This bainite microstructure is a function of: (1) composition, particularly the hardenability agents discussed in detail above; and (2) the cooling rate due to (a) the air blowing by blowers 28 as well as (b) the conveying speed along horizontally spaced rollers 27 because that speed determines the length of time the succession of overlapping loops 15 is subjected to cooling by air blowers 28. An example of a cooling rate, for obtaining the desired bainite microstructure, can be defined as 4°–8° C. per second (e.g. 5° C. per second) at 700° C. If the cooling rate is too slow, one will obtain a microstructure containing ferrite, which is undesirable from a strength standpoint, or one could also get pearlite in the microstructure which also is undesirable. In attempting to obtain the desired bainitic microstructure employing air blowers 28 and a conveyor comprising horizontally spaced rollers 27, one cannot cool too fast with this equipment.

A hot rolled steel bar in accordance with the present invention has the following physical properties:

| | |
|---|---|
| yield strength | 65–85 ksi (448–586 MPa) |
| tensile strength | 95–105 ksi (655–724 MPa) |
| total elongation | 20–26% |
| reduction in area | 58–70% |

A hot rolled steel bar prepared in accordance with the present invention typically has a fracture toughness (Charpy V-notch test) reflected by the following dam:

| | Test Specimen | Energy Absorbed At Test Temperature (°C.), in Foot-Pounds (Joules) | | | |
|---|---|---|---|---|---|
| Initial Bar Diameter, cm | Rectangular Cross-Secton, cm | Room Temp. | −18° | −29° | −40° |
| 1.63 | 1 × 1 | 37 (50.14) | 16 (21.68) | 15 (20.33) | |
| 1.43 | 1 × 1 | 48 (66.40) | 22 (29.81) | 14 (18.97) | 10 (13.55) |
| 1.19 | 1 × 0.5 | 38 (51.49) | 18 (24.39) | 13 (17.62) | 10 (13.55) |

A bar having a diameter in the range 1.43–1.63 cm has a fracture toughness of 15 foot lbs. (20.33 Joules) at −27° C., and a bar having a diameter of 1.19 cm has a fracture toughness of 10 foot lbs. (13.55 Joules) at −40° C.

The amount of reduction which the intermediate product undergoes at 13, during the second hot rolling step, and the temperature at which this reduction takes place, establish the austenitic grain size which is important from the standpoint of determining the fineness of the bainitic structure (i.e. the number of packets 20 of bainite per unit area) and therefore the toughness of the steel bars. The bainite packet size is related to the prior austenite grain size, although that is not the only factor involved in determining packet size. Nevertheless, control of the prior austenite grain size is at least a first step in reducing the bainite packet size so as to improve toughness.

As noted above with reference to FIG. 2, a hot rolled bar coiled at 17 optionally can be partially cold drawn at 24 before shipping to the customer who subjects the hot rolled bar from 17, or the partially cold drawn bar from 24, to a cold deforming operation at 26. Whether the starting material for the cold deforming operation is a coil of hot rolled steel bar from 17 or a partially cold drawn steel bar from 24, the cold deforming operation at 26 deforms the bar to a final, cold deformed product. A typical final, cold deformed product is a threaded fastener such as a bolt or a screw. These threaded fasteners can be produced by high-speed, fastener-forming machines which cold form a fastener head and cold roll fastener threads in a single, continuous operation. When threaded fasteners are thus formed from a steel bar produced in accordance with the present invention, it is unnecessary to perform any heat treating steps after the fastener head is cold formed and the threads are cold rolled. The final, cold deformed product is undistorted, and, therefore, no straightening step is required.

The step of cold rolling fastener threads imparts residual compressive stresses to the final, cold deformed product, and this improves the fatigue resistance of the threaded fastener. A heating step after cold deforming would remove these residual compressive stresses which are retained when employing a hot rolled bar made in accordance with the present invention because, in such a case, no such heating step is required or used.

As noted above, when the starting material is a partially cold drawn bar, such as that obtained at 24 (FIG. 2), cold deforming to a final, cold deformed product can be performed without subjecting the partially cold drawn bar to a spheroidizing anneal. Similarly, when the starting material is a hot rolled bar from 17, no spheroidizing anneal is performed before the cold deforming operation, either by the producer of the hot rolled bar or thereafter.

A threaded fastener produced from a bar made in accordance with the present invention will have a tensile strength of at least about 120 ksi (827 MPa) and a Rockwell C hardness of at least 25. In order to obtain these physical properties, one must subject the bar from which the final, cold deformed product is made, to cold deformation operations, such as cold drawing or extruding, in addition to the cold heading and cold rolling of threads. When one employs, as the starting material, a hot rolled bar produced in accordance with the present invention, one can initially subject the bar to a substantial amount of cold drawing or cold extruding and still retain, in the cold drawn or cold extruded bar, enough ductility to form the fastener shape by cold heading, further extruding, and cold rolling of the threads.

The final, finished product after cold deforming, is a threaded fastener comprising a fastener head and cold rolled fastener threads. The fastener is undistorted and contains residual compressive stresses imparted thereto by the cold rolling of the threads. The fastener has a steel microstructure consisting essentially of bainite in relatively fine-sized packets corresponding to an austenitic grain size in the range 8–11 ASTM. The bainite is substantially devoid of spheroidized iron carbide particles of the type produced by a heat treating operation (i.e. one micron or larger, in diameter).

Improved fatigue strength in the fastener is another advantage resulting from the present invention. Standard fatigue testing was conducted on one-half inch (1.27 cm) lockbolts (a) made in accordance with the present invention from hot rolled bars made in accordance with the present invention and (b) made from 1038-Mod steel with the fastener subjected to heating, quenching and tempering after cold deforming. The lockbolts in category (a) displayed significantly better fatigue strength; at various maximum test loads between 6,820 lbs. (3,069 kg) and 13,640 lbs. (6,138 kg) there was an increase in fatigue strength in the range 20% to 129%, depending upon the test load.

The foregoing detailed description has been given for clearness of understanding only, and no unnecessary limitations should be understood therefrom, as modifications will be obvious to those skilled in the art.

We claim:

1. A method for producing a hot rolled steel bar capable of subsequent cold deformation, said method comprising the steps of:

providing a billet having a steel composition consisting essentially of, in wt. %,

| | |
|---|---|
| carbon | 0.10–0.14 |
| manganese | 1.35–1.60 |
| silicon | 0.20–0.35 |
| niobium | 0.05–0.10 |
| boron | 0.001–0.004 |
| molybdenum | 0.01–0.1 |
| titanium | 0.008–0.020 |
| nitrogen | less than 0.008 |
| aluminum | 0.020–0.030 |

and a balance consisting essentially of iron;

subjecting said billet to a first hot rolling step to produce an intermediate hotrolled product;

providing said billet with a temperature in the range 1175° to 1230° C. (2147° to 2246° F.) at the beginning of the first hot rolling step;

cooling said intermediate product to a temperature in the range 780° to 900° C. (1420° to 1650° F.) following said first hot rolling step;

subjecting the cooled intermediate product to a second hot rolling step to produce a continuous hot rolled bar;

gathering said continuous hot rolled bar into a succession of overlapping loops;

providing said continuous, hot rolled bar with a gathering temperature in the range 780° to 855° C. (1420° to 1570° F.) at the beginning of said gathering step;

conveying said succession of overlapping loops through a cooling stage in which air at ambient temperature is blown through said loops to cool the loops to a temperature below 427° C. (800° F.);

and then coiling said loops.

2. A method as recited in claim 1 wherein:

said second hot rolling step provides said continuous, hot rolled bar with an austenitic microstructure having a relatively fine average austenitic grain size in the range 8 to 11 ASTM;

and said austenitic microstructure undergoes transformation, during said conveying step, into a microstructure consisting essentially of bainite in relatively fine-sized packets reflecting the prior average austenitic grain size.

3. A method as recited in claim 2 and comprising:

cooling said overlapping loops during said conveying step at a rate sufficiently rapid to substantially avoid the formation of either ferrite or pearlite.

4. A method as recited in claim 2 wherein:

the bainite resulting from said transformation is at least primarily upper bainite.

5. A method as recited in claim 2 and comprising:

imparting to the hot rolled bar in the coiled loops, as a result of said previously recited method steps, the following physical properties:

| | |
|---|---|
| yield strength | 65–85 ksi (448–586 MPa) |
| tensile strength | 95–105 ksi (655–724 MPa) |
| total elongation | 20–26% |
| reduction in area | 58–70% |

6. A method as recited in claim 5 wherein said physical properties include:

a fracture toughness of 15 foot lbs. (20.33 Joules) at −27° C. for a bar having a diameter in the range 1.43–1.63 cm, and a fracture toughness of 10 foot lbs. (13.55 Joules) at 40° C. for a bar having a diameter of 1.19 cm.

7. A method as recited in claim 1 and comprising:

cooling said continuous hot rolled bar with a cooling fluid between said second hot rolling step and said gathering step.

8. A method as recited in claim 1 and comprising:

employing a turbulent cooling liquid to cool said intermediate product between said first and second hot rolling steps.

9. A method as recited in claim 1 wherein:

said continuous, hot rolled bar undergoes sufficient cooling prior to the beginning of said gathering step to provide said gathering temperature of 780° to 855° C. without any deliberate cooling step between said second hot rolling step and the gathering step.

10. A method as recited in claim 1 and comprising:

cooling said coiled loops to room temperature; and subjecting the hot rolled, steel bar from the coiled loops to a partial cold drawing operation to produce a partially cold drawn bar.

11. A method for producing a cold deformed product, said method comprising:

employing, as starting material, a partially cold drawn bar produced in accordance with the method of claim 10;

and cold deforming said partially cold drawn bar to a final, cold deformed product, without annealing said partially cold drawn bar.

12. A method as recited in claim 11 wherein said final, cold deformed product is a threaded fastener and the cold deforming method comprises:

forming a fastener head and rolling fastener threads, to provide said final, cold deformed product;

said method being devoid of any heat treating steps after said forming and rolling step.

13. A method as recited in claim 12 wherein:

said final cold deformed product is undistorted; and said method is devoid of any straightening step.

14. A method as recited in claim 12 wherein:

said step of rolling fastener threads imparts residual compressive stresses to said final, cold deformed product, to improve the fatigue resistance thereof;

and said method is devoid of any heat treating step which would remove said residual stress.

15. A method as recited in claim 1 wherein:

said steel composition consists essentially of, in wt. %,

| | |
|---|---|
| carbon | 0.11–0.13 |
| manganese | 1.40–1.55 |
| silicon | 0.24–0.28 |
| niobium | 0.08–0.10 |
| boron | 0.001–0.003 |
| molybdenum | 0.06–0.08 |
| titanium | 0.010–0.015 |
| nitrogen | less than 0.004 |
| aluminum | 0.020–0.025 |

and a balance consisting essentially of iron.

16. A method as recited in claim 15 wherein:

said steel composition includes 0.16–0.18 wt. % chromium.

17. A method as recited in claim 1 or 15 wherein:

said steel composition is devoid of vanadium.

18. A method as recited in claim 1 or 15 wherein:

said steel composition has a 0.010 wt. % max. sulfur.

19. A method as recited in claim 1 or 15 wherein:

said steel composition has up to 0.020 wt. % sulfur.

20. A method as recited in claim 1 or 15 wherein:

said steel composition has 0.10 wt. % max. nickel and 0.12 wt. % max. copper.

21. A method as recited in claim 1 wherein:

said steel composition includes 0.15–0.25 wt. % chromium.

22. A method as recited in claim 1 wherein:

said billet is provided with a temperature in the range 1180° to 1200° C. (2156° to 2192° F.) at the beginning of said first hot rolling step.

23. A method as recited in claim 1 wherein:

said intermediate product is cooled to a temperature below about 870° C. (1598° F.) following said first hot rolling step.

24. A method as recited in claim 1 wherein:

said intermediate product is cooled to a temperature in the range 800° to 830° C. (1472° to 1526° F.) following said first hot rolling step.

25. A method as recited in claim 1 wherein:

said first hot rolling step provides a reduction greater than 80%.

26. A method as recited in claim 25 wherein:

said first hot rolling step provides a reduction in the range 85%–90%.

27. A method for producing a cold deformed steel product, said method comprising:

employing, as starting material, a hot rolled steel bar produced in accordance with the method of claim 2;

cold deforming said hot rolled steel bar into a final cold deformed product having residual compressive stresses in said final product;

said method being devoid of any heat treating step which would remove said residual stresses.

28. A method as recited in claim 27 wherein:

said final product is undistorted;

and said method is devoid of a straightening step.

29. A method as recited in claim 27 wherein:

said bainite in said hot rolled steel bar is substantially devoid of spheroidized iron carbides particles having a diameter of at least one micron;

and said method is devoid of a spheroidizing anneal.

30. A method as recited in claim 27 wherein:

said steel composition consists essentially of, in wt. %,

| | |
|---|---|
| carbon | 0.11–0.13 |
| manganese | 1.40–1.55 |
| silicon | 0.24–0.28 |
| niobium | 0.08–0.10 |
| boron | 0.001–0.003 |
| molybdenum | 0.06–0.08 |
| titanium | 0.010–0.015 |
| nitrogen | less than 0.004 |
| aluminum | 0.020–0.025 |

and a balance consisting essentially of iron.

31. A hot rolled steel bar capable of subsequent cold deforming, said bar comprising:

a steel composition consisting essentially of, in wt. %,

| | |
|---|---|
| carbon | 0.10–0.14 |
| manganese | 1.35–1.60 |
| silicon | 0.20–0.35 |
| niobium | 0.05–0.10 |
| boron | 0.001–0.004 |

-continued

| | |
|---|---|
| molybdenum | 0.01–0.1 |
| titanium | 0.008–0.020 |
| nitrogen | less than 0.008 |
| aluminum | 0.020–0.030 |

with a balance consisting essentially of iron;

and a microstincture consisting essentially of bainite in relatively fine-sized packets reflecting a prior average austenitic grain size in the range 8–11 ASTM.

32. A hot rolled steel bar as recited in claim 31 and comprising the following physical properties:

| | |
|---|---|
| yield strength | 65–85 ksi (448–586 MPa) |
| tensile strength | 95–105 ksi (655–724 (MPa) |
| total elongation | 20–26% |
| reduction in area | 58–70% |

33. A bar as recited in claim 32 wherein said physical properties include:

a fracture toughness of 15 foot lbs. (20.33 Joules) at −27° C. for a bar having a diameter in the range 1.43–1.63 cm, and a fracture toughness of 10 foot lbs. (13.55 Joules) at 40° C. for a bar having a diameter of 1.19 cm.

34. A hot rolled steel bar as recited in claim 31 or 32 wherein:

said bainite is substantially devoid of spheroidized iron carbide having a diameter of at least one micron.

35. A hot rolled steel bar as recited in claim 31 wherein:

said steel composition consists essentially of, in wt. %,

| | |
|---|---|
| carbon | 0.11–0.13 |
| manganese | 1.40–1.55 |
| silicon | 0.24–0.28 |
| niobium | 0.08–0.10 |
| boron | 0.001–0.003 |
| molybdenum | 0.06–0.08 |
| titanium | 0.010–0.015 |
| nitrogen | less than 0.004 |
| aluminum | 0.020–0.025 |

and a balance consisting essentially of iron.

36. A hot rolled steel bar as recited in claim 35 wherein:

said steel composition includes 0.16–0.18 wt. % chromium.

37. A hot rolled steel bar as recited in claim 31 or 35 wherein:

said steel composition is devoid of vanadium.

38. A hot rolled steel bar as recited in claim 31 or 35 wherein:

said steel composition has 0.010 wt. % max. sulfur.

39. A hot rolled steel bar as recited in claim 31 or 35 wherein:

said steel composition has up to 0.020 wt. % sulfur.

40. A hot rolled steel bar as recited in claim 31 or 35 wherein:

said steel composition has 0.10 wt. % max. nickel and 0.12 wt. % max. copper.

41. A hot rolled steel bar as recited in claim 31 wherein:

said steel composition includes 0.15–0.25 wt. % chromium.

42. A cold deformed, threaded fastener comprising:

a fastener head and rolled fastener threads;

said fastener being undistorted and containing residual compressive stresses imparted thereto by the cold rolling of said threads;

said fastener having a steel microstincture consisting essentially of bainite in relatively fine-sized packets corresponding to an average austenitic grain size in the range 8 to 11 ASTM.

43. A fastener as recited in claim 42 and comprising a steel composition consisting essentially of, in wt. %:

| | |
|---|---|
| carbon | 0.10–0.14 |
| manganese | 1.35–1.60 |
| silicon | 0.20–0.35 |
| niobium | 0.05–0.10 |
| boron | 0.001–0.004 |
| molybdenum | 0.01–0.1 |
| titanium | 0.008–0.020 |
| nitrogen | less than 0.008 |
| aluminum | 0.020–0.030 |

and a balance consisting essentially of iron.

44. A fastener as recited in claim 42 or 43 wherein:

said bainite is substantially devoid of spheroidized iron carbide particles having a diameter of at least one micron.

45. A fastener as recited in any of claims 42–44 and having the following physical properties:

| | |
|---|---|
| tensile strength | at least 120 ksi (827 MPa) |
| hardness | at least 25 Rockwell C. |

46. A method as recited in claim 1 wherein said molybdenum content is at least 0.06 wt. %.

47. A hot rolled steel bar as recited in claim 31 wherein said molybdenum content is at least 0.06 wt. %.

48. A fastener as recited in claim 43 wherein said molybdenum content is at least 0.06 wt. %.

49. A hot rolled steel bar as recited in claim 31 wherein said bainite is at least primarily upper bainite.

50. A fastener as recited in claim 42 wherein said bainite is at least primarily upper bainite.

* * * * *

UNITED STATES PATENT AND TRADEMARK OFFICE

CERTIFICATE OF CORRECTION

PATENT NO. : 5,554,233

DATED : September 10, 1996

INVENTOR(S) : William E. Heitmann and Birchel S. Brown

It is certified that error appears in the above-identified patent and that said Letters Patent is hereby corrected as shown below:

Title page, item [57],
IN THE ABSTRACT

| | |
|---|---|
| Line 9 in the abstract | "microstincture" should be --microstructure--. |
| Col. 2, line 1, | "bainite" should be --bainitic--. |
| Col. 4, line 7, | "bainite" should be --bainitic--. |
| Col. 4, line 8, | "bainite" should be --bainitic--. |
| Col. 4, line 62, | "bahrite" should be --bainite--. |
| Col. 5, line 45, | "carded" should be --carried--. |
| Col. 5, line 61, | "rust" should be --first--. |
| Col. 6, line 52, | "bainite" should be --bainitic--. |
| Col. 6, line 53, | "bainite" should be --bainitic--. |
| Col. 6, line 61, | "bainite" should be --bainitic--. |

UNITED STATES PATENT AND TRADEMARK OFFICE

CERTIFICATE OF CORRECTION

PATENT NO. : 5,554,233

DATED : September 10, 1996

INVENTOR(S) : William E. Heitmann and Birchel S. Brown

It is certified that error appears in the above-identified patent and that said Letters Patent is hereby corrected as shown below:

Col. 9, line 13, "hotrolled" should be -- -hot-rolled --.

Col. 9, line 67, "40°C" should be -- -40°C--.

Col. 12, line 8, "microstincture" should be --microstructure--.

Col. 12, line 24, "40°C" should be -- -40°C --.

Col. 13, line 1, "microstincture" should be --microstructure--.

Signed and Sealed this

Sixth Day of May, 1997

*Attest:*

*Attesting Officer*

BRUCE LEHMAN

*Commissioner of Patents and Trademarks*